US007172228B1

(12) United States Patent
Sahagun et al.

(10) Patent No.: US 7,172,228 B1
(45) Date of Patent: Feb. 6, 2007

(54) BOTTLE MANIPULATION DEVICE AND METHODS

(76) Inventors: George Sahagun, 1906 W. Pamela Ave., Porterville, CA (US) 93257; Douglas Diggles, 4512 Parkwood Ct., Bakersfield, CA (US) 93309

( * ) Notice: Subject to any disclaimer, the term of this patent is extended or adjusted under 35 U.S.C. 154(b) by 464 days.

(21) Appl. No.: 10/658,542

(22) Filed: Sep. 8, 2003

(51) Int. Cl.
*B65D 23/10* (2006.01)

(52) U.S. Cl. ..... 294/28; 294/31.1; 215/396

(58) Field of Classification Search ..... 294/27.1, 294/28, 30, 31.1, 33, 19.1, 19.3, 50.9, 90, 294/104, 10; 215/396; 220/758, 759, 769
See application file for complete search history.

(56) References Cited

U.S. PATENT DOCUMENTS

| | | | | | |
|---|---|---|---|---|---|
| 547,713 | A | | 10/1895 | Courtenay | |
| 1,016,421 | A | | 2/1912 | Landau | |
| 1,190,581 | A | | 7/1916 | Pfeninger | |
| 1,335,369 | A | | 3/1920 | Donohue | |
| 1,394,086 | A | | 10/1921 | Heckmann | |
| 1,464,789 | A | | 8/1923 | Ward | |
| 1,559,687 | A | | 11/1925 | Fairchild | |
| 1,634,363 | A | | 7/1927 | Jabs | |
| 1,713,415 | A | | 5/1929 | Allen | |
| D88,100 | S | | 10/1932 | Lehman | |
| 1,978,033 | A | | 10/1934 | Suppes | |
| 1,989,436 | A | | 1/1935 | Weigand | |
| 2,300,744 | A | * | 11/1942 | Jenkins | 294/33 |
| 2,300,745 | A | | 11/1942 | Jenkins | |
| 2,463,651 | A | | 3/1949 | Stevens | |
| 2,598,747 | A | * | 6/1952 | Alex | 294/27.1 |
| 2,610,081 | A | * | 9/1952 | Bushman | 294/28 |
| 2,765,969 | A | | 10/1956 | Bennington | |
| 2,810,503 | A | | 10/1957 | Krueger | |
| 2,860,907 | A | | 11/1958 | Vanciel | |
| 2,942,828 | A | | 6/1960 | Kondrat | |
| 2,979,225 | A | | 4/1961 | Noffsinger | |
| 3,021,026 | A | | 2/1962 | Clare | |
| 3,458,164 | A | | 7/1969 | Massey | |
| 3,458,230 | A | * | 7/1969 | Jones et al. | 294/90 |
| 3,610,671 | A | | 10/1971 | Conger | |
| 3,688,936 | A | | 9/1972 | Killigrew, Jr. | |
| 3,979,011 | A | | 9/1976 | Schleicher | |
| 4,336,899 | A | | 6/1982 | Price, II | |
| 4,456,135 | A | * | 6/1984 | Beekes | 215/396 |
| 4,486,043 | A | | 12/1984 | Rais | |
| 4,552,396 | A | | 11/1985 | Rais | |
| 4,627,546 | A | | 12/1986 | Carranza | |
| 4,666,197 | A | | 5/1987 | Watson et al. | |
| 4,667,359 | A | | 5/1987 | Polotti | |

(Continued)

*Primary Examiner*—Dean J. Kramer
(74) *Attorney, Agent, or Firm*—Schmeiser, Olsen & Watts LLP

(57) ABSTRACT

A bottle manipulation device facilitates one-handed manipulation and pouring from a bottle. The device has a bottle engaging member with a U-shaped fork having first and second branches on opposite sides of a bisecting plane for engaging on first and second opposite sides of a neck of a bottle respectively. A hook is pivotally connected to the bottle engaging portion for movement between a disengaged position with a blocking portion of the hook spaced from the bisecting plane and an engaged position with the blocking portion of the hook passing through the bisecting plane and blocking a front of the neck of the bottle for secure engagement of the bottle with the device. A method of using the device provides for secure manipulation and pouring.

15 Claims, 2 Drawing Sheets

U.S. PATENT DOCUMENTS

| | | | | | |
|---|---|---|---|---|---|
| D292,160 | S | | 10/1987 | Thomas | |
| 4,768,403 | A | * | 9/1988 | Bar-Noy | 81/3.15 |
| 4,823,975 | A | | 4/1989 | Schwankl | |
| 4,865,208 | A | | 9/1989 | Lax et al. | |
| 4,896,913 | A | | 1/1990 | Kennedy | |
| D309,072 | S | | 7/1990 | Golkar | |
| 4,982,869 | A | | 1/1991 | Robbins, III | |
| 5,013,074 | A | | 5/1991 | Galle | |
| 5,025,940 | A | | 6/1991 | Akly | |
| 5,085,477 | A | * | 2/1992 | Gagnon | 294/28 |
| 5,176,280 | A | | 1/1993 | Robbins, III | |
| 5,183,169 | A | | 2/1993 | Grzych | |
| 5,335,954 | A | | 8/1994 | Holub et al. | |
| 5,385,277 | A | | 1/1995 | Drew et al. | |
| 5,413,231 | A | | 5/1995 | Carroll et al. | |
| 5,601,324 | A | | 2/1997 | Purcell | |
| 5,816,631 | A | | 10/1998 | Kochan | |
| 5,897,150 | A | | 4/1999 | Rubini | |
| 5,951,076 | A | | 9/1999 | Marco | |
| 6,042,164 | A | * | 3/2000 | Merritt | 294/28 |
| 6,378,924 | B1 | | 4/2002 | McCrumb | |

* cited by examiner

BOTTLE MANIPULATION DEVICE AND METHODS

BACKGROUND OF THE INVENTION

1. Technical Field

This invention generally relates to a bottle manipulation device and more particularly to a handle that is attachable and removable from a bottle for facilitating manipulation of the bottle.

2. State of the Art

Handles and other holding and manipulating devices have been developed over the years for the purpose of facilitating handling of bottles. These devices have been used, in particular, for facilitating pouring from the bottles with the aid of a grip or handle portion that is easily grasped by a user's hand. Some bottles and other containers are easily grasped without the aid of such a handle or manipulation device. Other bottles are more difficult to handle and call for such a handle to be employed.

Of particular interest in this field, are the two liter bottles that are often used to store and dispense soft drinks. These two liter bottles are particularly challenging to handle because of the thin sidewalls that are often slippery. This is especially true when the user's hands are greasy or wet, in which case the bottle can easily slip from the user's grasp and be spilled.

One of the disadvantages that results from manipulation of the two liter soft drink bottles is that when the lid is on the bottle and the sidewalls are squeezed, the pressure in the bottle fluctuates and thereby causes loss of carbonation of the soft drink. Furthermore, both when the lid is on and when the lid is off the bottle, the agitation of the soft drink caused by the collapsing sidewalls also causes loss of carbonation.

Also, during pouring of the soft drink the center of gravity of the bottle and its contents shifts toward the neck of the two liter bottle. In response to the shifting weight a user's hand will naturally grip the sidewalls with a greater force to prevent loss of control of the bottle. The result is often an inadvertent sloshing out of the contents similar to the squeezing out of toothpaste or some other liquid, (or semi-liquid), product from a tube. The soft drink is sloshed out from the two liter bottle similar, in this case, to contents dispensed from a container that is intended to be a squeeze bottle. Thus, the two liter bottles may have the disadvantage of causing spills or otherwise causing the soft drink to pour out too fast when a user tries to manipulate the bottle with one hand. This problem may be improved by using two hands on the two liter bottle. On the other hand, using two hands to pour from a two liter bottle is not always convenient or possible. Therefore, many efforts have been made to form bottle manipulation devices including attachable handles for controlling two liter bottles during pouring. Some of these handles are more effective than others. Some are complex, and others are relatively simple. However, it is believed that all of the bottle manipulation devices and detachable handles of the past are deficient in providing the advantages of the present invention. Many of the advantages of the present invention are not fully realized by the devices of the past.

DISCLOSURE OF THE INVENTION

The present invention relates to a manipulation device for holding and controlling a bottle, and in particular to a bottle manipulation device that includes a handle or a grip that can be grasped by one hand of a user for easy manipulation of a bottle during pouring. The bottle manipulation device of the present invention includes a bottle engaging portion and a hook member that surroundingly engage a neck of a bottle and hold the bottle securely. The bottle manipulation device also includes a pistol grip handle that is supported on the bottle engaging portion and extends rearwardly and downwardly from the rest of bottle manipulation device. The grip is spaced from the bottle by a standoff portion of the bottle engaging member when engaged on a bottle so that a user's fingers can be placed between the grip and the bottle. The bottle engaging portion and the hook member hold the bottle securely so that the bottle can be manipulated in any direction or orientation without the risk of the bottle slipping from the bottle manipulation device and spilling its contents. Thus, a user can easily grasp the bottle manipulation device with one hand and easily manipulate the bottle to pour its contents when the bottle manipulation device is in an engaged position connected to the bottle.

In a simple form the bottle manipulation device includes a bottle engaging member, a grip supported on the bottle engaging member, and a hook pivotally connected to the bottle engaging member. The grip lies in a plane that generally bisects the bottle engaging member. The hook is pivotally connected to the engaging member by a pivotal connection that also lies generally in the bisecting plane. A portion of the hook is movable from a disengaged position that is out of the bisecting plane to an engaged position passing through the bisecting plane.

To provide a secure holding structure, the bottle engaging member includes a U-shaped fork with a respective branch of the fork on each opposite side of the bisecting plane. Thus, each branch of the fork is adapted to engage a respective opposite side of a neck of a bottle. The blocking portion of the hook moves into the engaged position blocking a front of the neck of the bottle between the two sides of the neck of the bottle. The hook is moved from the disengaged position into the engaged position by the user. To do so, he or she engages his or her thumb on a thumb engaging portion of the hook and applies pressure until the hook is forced around the front of the neck of the bottle. In this engaged position, the standoff portion of the bottle engaging member supports the grip in a pistol grip configuration extending downwardly and rearwardly relative to the bottle engaging portion and the bottle itself in an engaged position of use.

The present invention also includes a method of pouring from a bottle including the step of engaging a bottle engaging member of a bottle manipulation device on a rear and two sides of a neck of a bottle. The method also includes the step of moving a hook member that is connected to the bottle engaging member into an engaged position engaging a front of the neck of a bottle. This step of moving the hooked member further includes a step of snap locking the hook member relative to the front of the neck of the bottle. Once the bottle manipulation device has been engaged on the bottle, the method further comprises the step of grasping a grip portion of the manipulation device and manipulating the bottle and the bottle manipulation device as a unit to control the bottle in a pouring movement. It should be noted that the step of moving the hook further comprises flexing a portion of the hook member in order to permit passage of at least part of the hook over a radially extending flange on a bottle neck.

The present invention also includes a method of advertising in which an advertisement is placed on a handle or grip portion of a bottle manipulation device. Since the bottle manipulation device is attachable to and detachable from a bottle, the method of advertising has the advantage of enabling broad distribution of the bottle manipulation devices. A multitude of bottle manipulation devices having a variety of advertising thereon can be connected to a multitude of soft drink bottles in a multitude of settings in which individuals will see the advertisements. Furthermore, the cost of production of the bottle manipulation devices can be defrayed by the advertising revenue collected so that the advertising provides an advantage to the individual(s) having the bottle manipulation device produced.

It is to be understood that the bottle manipulation device of the present invention is exceedingly simple yet has the advantage of securely being connected to a bottle for facilitating one handed manipulation and pouring from the bottle. The foregoing and other features and advantages of the present invention will be apparent from the following more detailed description of the particular embodiments of the invention, as illustrated in the accompanying drawings.

DETAILED DESCRIPTION OF EMBODIMENTS OF THE INVENTION

Figure 1:
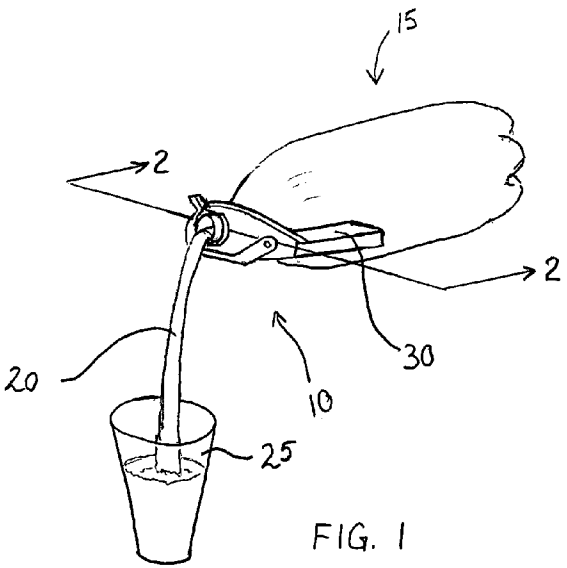
FIG. 1 is a perspective view of the bottle manipulation device in an engaged position on a bottle showing a pouring function in accordance with the present invention.

As discussed above, embodiments of the present invention relate to a bottle manipulation device 10 for engagement on a bottle 15 as shown in FIG. 1. FIG. 1 is a perspective view of the bottle manipulation device 10 and the bottle 15 disposed in a position of pouring. For example, the device 10 is used for pouring a soft drink 20 into a glass 25. Although not shown in FIG. 1, a user's hand supports the bottle 15 and the bottle manipulation device 10 in the orientation shown by grasping a grip 30 and maintaining the device 10 and the bottle 15 as a unit in the position shown. As can be appreciated, the bottle manipulation device 10 thus facilitates pouring a beverage such as the soft drink 20 with one hand grasping the grip 30.

Figure 2:
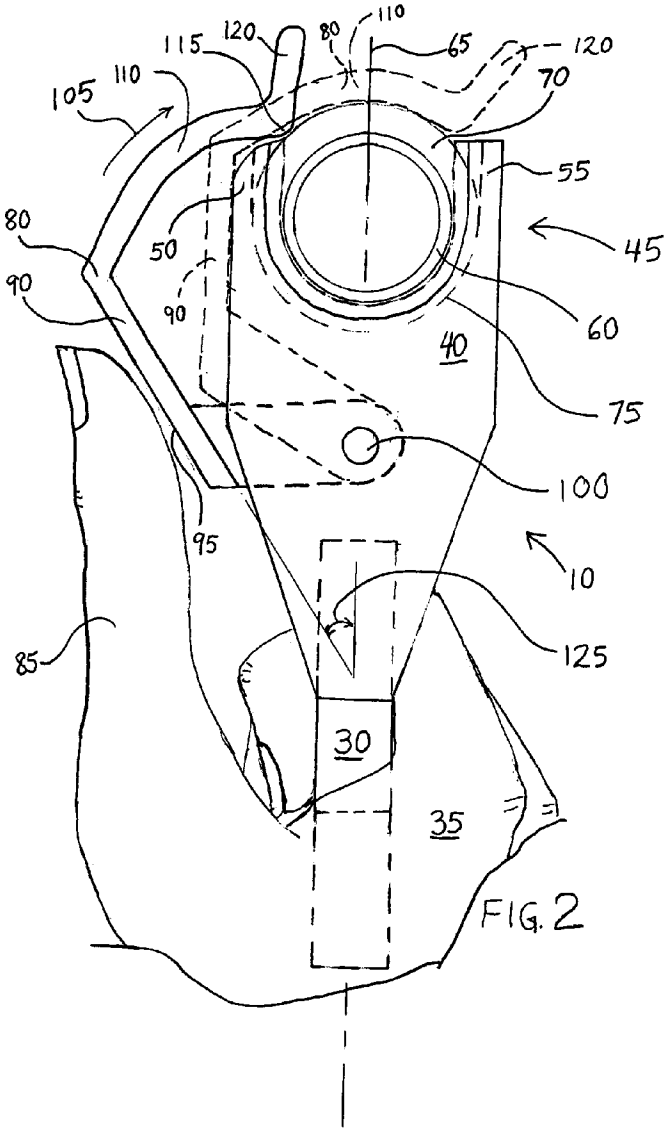
FIG. 2 is a diagrammatic top plan view of the bottle manipulation device taken along lines 2—2 of FIG. 1.

FIG. 2 is a top plan view of the device 10 of FIG. 1 taken along lines 2—2 of FIG. 1. As diagrammatically shown in FIG. 2, a user's hand 35 grasps the grip 30 in a pistol grip style. The grip 30 is rigidly supported on a bottle engaging member 40. The bottle engaging member 40 has a U-shaped fork 45 with a first branch 50 and a second branch 55 for engaging on respective opposite sides of a bottle neck 60 relative to a bisecting plane 65. The bisecting plane 65 generally bisects the bottle engaging portion 40 and the overall bottle engaging device 10. As can be appreciated, a radially extending flange 70 is rigidly supported on and extends from the bottle neck 60. This flange can thus advantageously be securely seated in a groove 75 in the inside of the U-shaped fork 45.

Once the bottle engaging portion 40 has been slid onto the neck 60 of a bottle 15, and the flange 70 has been received in the groove 75 in a seated position, the user can manipulate a hook 80 with his or her thumb 85 to move the hook 80 from a disengaged position shown in solid lines to an engaged position shown in dashed lines. To this end, the hook 80 has a thumb engaging portion 90 with a thumb engaging surface 95 easily accessible by the user's thumb 85.

As shown in FIG. 2, the hook 80 is pivotally connected to the bottle engaging member 40 by a pivot connection 100. Thus, when a user applies a force on the thumb engaging surface 95, the hook 80 is caused to rotate in a clockwise direction as indicted by arrow 105. In the disengaged position shown in solid lines in FIG. 2, the hook 80 is in a relaxed state. However, in order for a user to move a blocking portion 110 into the engaged position abutting and blocking radially extending flange 70 of the neck 60, the hook 80 must be flexed. Specifically, the user causes a heel portion 115 to engage the radially extending flange 70. Then the user applies a force to the thumb engaging portion 90. As the user continues to apply pressure, the thumb engaging portion 90 and the locking portion 110 flexes to permit the heel portion 115 to slide over the radially extending flange 70 in the clockwise direction until the hook 80 reaches the engaged position shown in dashed lines. Once the hook 80 reaches the engaged position, the heel portion 115 may no longer applying any force to or receiving any force from the radially extending flange 70.

As shown in FIG. 2, the arc of the blocking portion 110 generally matches the arc of the radially extending flange 70 so that in the engaged position, the hook is in a generally relaxed state. At the same time, the blocking portion 110 is also in an abutting or blocking position. As can be appreciated, the flexing of the hook 80 between the disengaged position and the engaged position provides a snap lock feature for the hook 80. Because of the resiliency of the material of the hook 80, the hook is biased into either the disengaged position or the engaged position. Automatic movement between these positions is aided in part by the generally slippery engagement between the heel portion 115 and the radially extending flange 70. Thus, once the user has forced the hook to a predetermined position in the clockwise direction, the hook will automatically snap into the engaged position shown in dashed lines. A foot or tab portion 120 is provided at a distal end of the blocking portion 110 of the hook 80. The tab portion 120 is adjoined to the blocking portion 110 generally by the heel portion 115. This tab portion 120 facilitates moving of the hook 80 from the engaged position shown in dashed lines to the disengaged position shown in solid lines. This can be accomplished by the user's fingers or thumb.

It should be noted that the pivot connection 100 lies in generally on the bisecting plane 65 of the bottle engaging member 40. Furthermore, the blocking portion 110 moves from a position spaced from the bisecting plane 65 in a disengaged position into a position extending through the bisecting plane 65 in an engaged position. Thus, it can be appreciated that a force of the bottle 15 in a direction along the bisecting plane 65 away from the bottle engaging member 40 will be blocked by the blocking portion 110 when the hook 80 is in the engaged position. Furthermore, such a force does not have the tendency to move the hook 80 into the disengaged position since the force is generally applied on a line through the pivot connection 100. This same advantage can be achieved as long as the pivot connection 100 is generally on or to the right of the bisecting plane 65 as shown in FIG. 2. With this configuration, an increased force applied by the radially extending flange on the blocking portion 110 in the engaged position will actually increase the force required for moving the hook 80 from the engaged position to the disengaged position. This is so because at least some of the required force would have to be received by the heel portion 115 as it passes over the radially extending flange 70 in the counterclockwise direction. As the force of the bottle on the blocking portion 110 increases, so does the reactive and spring forces in the hook 80 in response to the force of the bottle. Thus, the force on the tab 120 in the counterclockwise direction that is required in order to overcome the force of the bottle is greater when the bottle is being forced out of the U-shaped fork 45 against the blocking portion 110. Therefore, an additionally advantageous feature of increased security against inadvertent separation of the bottle from the bottle manipulation device is provided.

As shown in FIG. 2, the thumb engaging member 90 is a relatively flat element and is disposed at an angle 125 relative to the bisecting plane 65 in the disengaged position. As shown, the angle 125 can be in a range from approximately 30 degrees to approximately 45 degrees relative to the bisecting plane 65. However, the thumb engaging portion 90 could be at an angle 125 in a range from approximately 20 degrees to approximately 70 degrees relative to the bisecting plane 65. As shown in dashed lines, the thumb engaging portion 90 is generally parallel to the bisecting plane 65 in the engaged position. However, the thumb engaging portion 90 can be disposed in a range from approximately 0 degrees to approximately 15 degrees in either direction relative to the plane 65 in the engaged position, as shown in FIG. 2.

Figure 3:
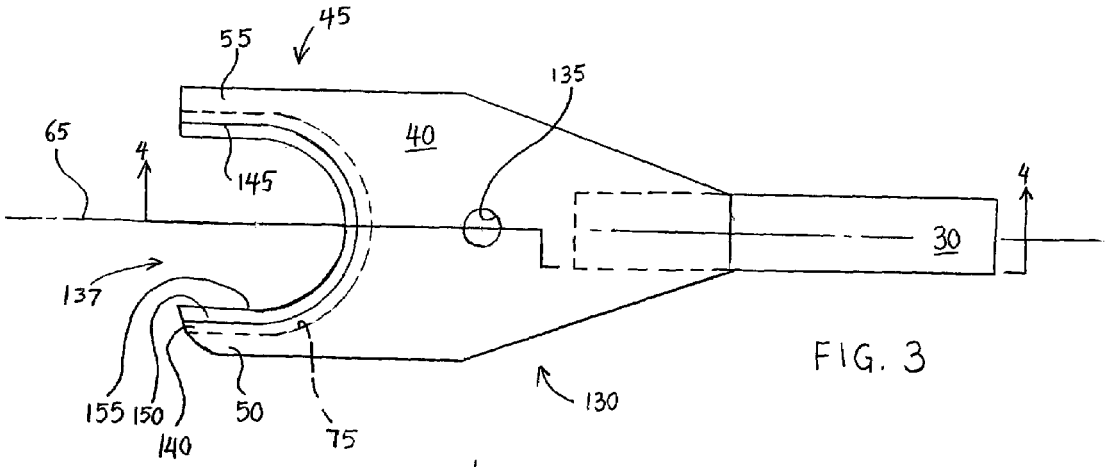
FIG. 3 is a top plan view of a portion of the bottle manipulation device similar to FIG. 2.

FIG. 3 is a top plan view of a portion of the bottle manipulation device as shown in FIG. 2, but having the user's hand 35 and the hook 80 removed for clarity. As shown in FIG. 3, the bottle engaging member 40 has the U-shaped fork 45 and a standoff portion 130 to which the grip 30 is rigidly connected. A through hole is formed by a through surface 135 extending through the bottle engaging member 40 in the standoff portion of 130. The through surface 135 forms a part of the pivot connection 100 shown in FIG. 2. The U-shaped fork 45 has its first branch 50 and its second branch 55. The U-shaped fork 45 forms an arcuate seat 137 for receiving the neck of a bottle. The seat 137 for the bottle neck formed by the U-shaped fork 45 comprises an upper flange 140 having an inwardly facing wall 145 for generally engaging a ring that is left behind when a seal of a bottle cap is broken. The seat 137 also includes a lower flange 150 having an inwardly facing surface 155. The inwardly facing surface 155 of the lower flange 150 is for engaging the bottle neck 60 below the radially extending flange 70 of the bottle as shown in FIG. 2. The upper flange 140 and the lower flange 150 generally define the groove 75 therebetween as indicated by a dashed line in FIG. 3.

Figure 4:
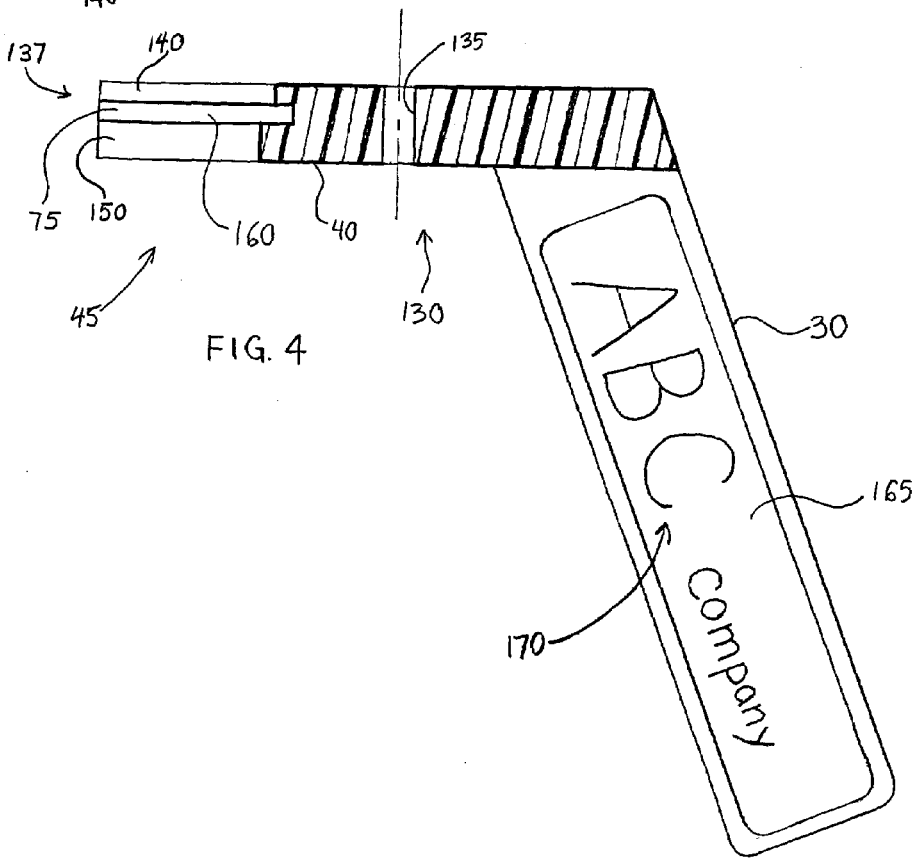
FIG. 4 is a partial sectional view of a portion of the bottle manipulation device taken along lines 4—4 of FIG. 3.

FIG. 4 is a sectional view of the bottle engaging member 40 and the grip 30 taken along lines 4—4 of FIG. 3. This sectional view is particularly beneficial in showing the contour of the seat 137 into which a bottle is inserted when engaging the bottle manipulation device 10 on the bottle. The groove 75 is disposed between the upper flange 140 and the lower flange 150 and has an inwardly facing wall 160, as shown in FIGS. 2–4. The groove 75 extends deeper into the bottle engaging portion 40 than does the rest of the seat 137 formed by the upper and lower flanges 140, 150.

In fact, the groove 75 has a larger radius of curvature than does the upper flange 140. The groove 160 and the upper flange 140 have larger radii of curvature than does the lower flange 150. The groove 160 can receive the radially extending flange 70 of a bottle in a relatively snug relation so that the bottle will not inadvertently slip from the groove 160 once the radially extending flange of the bottle has been inserted therein. In this case, the hook 80 may not even be required in order to hold the bottle securely on the bottle manipulation device 10. However, the hook 80 provides an additionally secure mechanism for preventing the bottle from being separated from the bottle manipulation device 10.

As shown in FIG. 4, the bottle engaging member 40 includes the standoff portion 130 that spaces the grip 30 from the U shaped fork 45. Thus, when the bottle manipulation device 10 is in the engaged position on a bottle, the grip 30 will be spaced from the bottle in order to provide space for a users fingers between the grip 30 and the bottle. Additionally the standoff portion 130 provides a space on the bottle engaging member 40 in which the through hole 135 can be provided for receiving a pin, a screw, a bolt, a rivet, a shaft, or the like, forming the pivot connection.

The grip 30 has at least one flat surface 165 on which advertising indicia 170 can be placed. This flat area 165 can be recessed. The recessed surface 165 can be provided on both sides of the grip 30 in a symmetrical arrangement about the bisecting plane 65, for example. Providing a recess or recesses in the grip 30 has the advantage of saving material as well as protecting any advertising indicia that is placed on the surface or surfaces 165 in the recesses. The advertising indicia 170 can be provided on a sticker having adhesive backing and disposed in the recesses 165, a name printed directly on the grip 30, or molded into a surface of the grip. FIG. 4 also shows the grip 30 rigidly connected to the bottle engaging member 40 at an angle that provides a pistol grip configuration. The grip 30 oriented as shown in FIG. 4 provides an ergonomic grip that permits a user's wrist to be positioned in a comfortable manner during grasping and pouring.

It is to be understood that the grip 30 can be configured in a number of different forms including forms having ergonomic surfaces to comfortably accommodate the users fingers and hand. Furthermore, it is to be understood that the U-shaped fork portion 45 can be alternatively configured to accommodate bottles having any other variety of neck configurations. For example, the U-shaped fork 45 can be formed to accommodate bottles made with a variety of radially extending flanges that may have larger of smaller radii. Some bottles may have little or no radially extending flange. It is to be understood that the U-shaped fork portion 45 can be made with different contours to accommodate these various bottle neck configurations. Further by way of example, the U-shaped fork portion 45 can be provided with a grommet or other member to take up space so that the bottle manipulation device 10 can be used on bottles having large flanges or neck portions and alternatively on bottles having smaller neck portions in which case a grommet or other member would be used in combination with the bottle manipulation device.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims.

The invention claimed is:

1. A method of using a bottle manipulation device, comprising the steps of:

engaging a bottle engaging member of a bottle manipulation device on a rear and two sides of a neck of a bottle;

moving a hook member connected to the bottle engaging member into an engaged position engaging a front of the neck of the bottle; and wherein the step of moving further comprises the steps of:

snap locking the hook member relative to the front of the neck of the bottle, and flexing a portion of the hook member to permit passage of said portion over the bottle neck.

2. The method of claim 1, wherein the step of engaging the bottle engaging member with the bottle further comprises sliding a U-shaped fork of the bottle engaging member onto the neck of the bottle.

3. The method of claim 1, wherein the step of engaging the bottle with the bottle engaging member further comprises sliding a slot of a U-shaped fork of the bottle engaging member over a flange on the neck of the bottle.

4. The method of claim 1, wherein the step of moving the hook member further comprises moving a portion of the hook member through a bisecting plane that generally bisects the bottle manipulation device.

5. The method of claim 1, further comprising the steps of:

grasping a grip portion that depends downwardly at a rear of the bottle engaging member; and manipulating the bottle and handle as a unit to control the bottle in a pouring movement.

6. The method of claim 1, wherein the step of flexing a portion of the hook member permits passage of said portion over a radially extending flange on a bottle neck.

7. The method of claim 6, wherein the steps of moving and snap locking comprise the step of flexing, and the step of flexing further comprises forcing the hook member from a relaxed state in a disengaged position through a flexed state when it passes over a radially extending flange to a relaxed state engaging the front of the neck of the bottle in the engaged position.

8. A method of using a bottle manipulation device, comprising the steps of:

engaging a bottle engaging member of a bottle manipulation device on a rear and two sides of a neck of a bottle;

moving a hook member connected to the bottle engaging member into an engaged position engaging a front of the neck of the bottle; and wherein the step of moving further comprises the steps of:

snap locking the hook member relative to the front of the neck of the bottle; and pivoting the hook member about a pivot generally on a bisecting plane of the bottle engaging member.

9. A bottle manipulation device, comprising:

a bottle engaging member, wherein the bottle engaging member comprises a bottle engaging portion and a standoff portion;

a grip supported on the bottle engaging member in a plane that generally bisects the bottle engaging member, wherein the grip depends downwardly from the standoff portion in a pistol grip configuration;

a hook pivotally connected to the bottle engaging member by a pivotal connection generally in said plane; and wherein a portion of the hook is movable from a disengaged position out of the plane to an engaged position passing through the plane.

10. The bottle manipulation device of claim 9, wherein the bottle engaging member comprises a U-shaped fork with a respective branch of the fork on each opposite side of said plane.

11. The bottle manipulation device of claim 9, wherein the bottle engaging member comprises a U-shaped fork with a groove extending transversely to said plane on an inside of the U-shaped fork.

12. The bottle manipulation device of claim 11, wherein:

the groove forms a seat for receiving a rear portion of a circular flange extending radially outward from a neck of a bottle; and the portion of the hook forms a blocking member for engaging a front portion of the flange in the engaged position.

13. The bottle manipulation device of claim 9, wherein the pivotal connection is disposed in the standoff portion generally between the grip and the bottle engaging portion.

14. A bottle manipulation device, comprising:

a bottle engaging member;

a grip supported on the bottle engaging member in a plane that generally bisects the bottle engaging member;

a hook pivotally connected to the bottle engaging member by a pivotal connection generally in said plane; wherein a portion of the hook is movable from a disengaged position out of the plane to an engaged position passing through the plane; wherein:

said portion of said hook further comprises a blocking portion;

the hook further comprising a thumb engaging portion; and wherein the thumb engaging portion is positioned generally between the blocking portion and the pivotal connection so that the thumb engaging portion is conveniently accessible by a user's thumb when the user's fingers are wrapped around the grip.

15. The bottle manipulation device of claim 14, wherein the thumb engaging portion has a thumb engaging surface disposed at an angle in a range from approximately twenty degrees to approximately seventy degrees relative to said plane in said disengaged position; and the thumb engaging surface is disposed at an angle in a range from approximately zero degrees to approximately fifteen degrees relative to said plane in said engaged position.

* * * * *